US010543952B2

(12) United States Patent
Wilson et al.

(10) Patent No.: US 10,543,952 B2
(45) Date of Patent: Jan. 28, 2020

(54) TWO CELL CHAMBERED CONTAINER WITH IMPROVED FLOW POURING SYSTEM

(71) Applicant: Packaging Corporation of America, Lake Forest, IL (US)

(72) Inventors: Rory I. Wilson, Crawford, TX (US); Marcus Humphrey, Waco, TX (US)

(73) Assignee: Packaging Corporation of America, Lake Forest, IL (US)

( * ) Notice: Subject to any disclaimer, the term of this patent is extended or adjusted under 35 U.S.C. 154(b) by 416 days.

(21) Appl. No.: 13/759,433

(22) Filed: Feb. 5, 2013

(65) Prior Publication Data

US 2014/0217102 A1 Aug. 7, 2014

(51) Int. Cl.
*B65D 5/48* (2006.01)
*B65D 25/04* (2006.01)
*B65D 5/72* (2006.01)

(52) U.S. Cl.
CPC ..... *B65D 5/48018* (2013.01); *B65D 5/725* (2013.01); *B65D 25/04* (2013.01)

(58) Field of Classification Search
CPC ..... B65D 5/48048; B65D 5/4608; B65D 2301/10
USPC ..... 229/120.18; 220/501
See application file for complete search history.

(56) References Cited

U.S. PATENT DOCUMENTS 1,898,231 A 2/1933 Weiss
2,980,540 A * 4/1961 Turpin ..... 426/112
3,029,711 A * 4/1962 Griese ..... 493/90
3,047,204 A * 7/1962 Wolowicz ..... 229/120.18
3,089,631 A * 5/1963 Tyrseck et al. ..... 206/490
3,106,876 A * 10/1963 Dewhurst ..... 493/92
3,130,892 A * 4/1964 Krueger et al. ..... 229/193
3,235,163 A * 2/1966 Hennessey ..... B65D 5/443 229/120.15
3,288,348 A * 11/1966 Brackett ..... 229/120.06
3,347,446 A * 10/1967 Guyer et al. ..... 229/120.18
3,758,021 A * 9/1973 Gordon-Ross ..... 229/120.011
3,965,803 A * 6/1976 Stone ..... 493/56
4,361,270 A 11/1982 Roccaforte

FOREIGN PATENT DOCUMENTS

FR 2667574 * 4/1992

* cited by examiner

*Primary Examiner* — Anthony D Stashick
*Assistant Examiner* — Blaine G Neway
(74) *Attorney, Agent, or Firm* — Klarquist Sparkman, LLP

(57) ABSTRACT

According to some aspects of the present disclosure, a container includes a bottom, a top opposing the bottom, and a plurality of sides extending from the bottom to the top. The bottom, the top and the plurality of sides define an enclosure. The container includes a partition panel extends from a first one of the plurality of sides to a second one of the plurality of sides thereby dividing the enclosure into a first chamber and a second chamber. The container further includes a pass-through opening in the partition panel configured to permit flow of contents from the second chamber into the first chamber. The container also includes a pour spout configured to permit egress of the contents from the first chamber out of the enclosure.

21 Claims, 5 Drawing Sheets

TWO CELL CHAMBERED CONTAINER WITH IMPROVED FLOW POURING SYSTEM

FIELD OF THE INVENTION

The present invention relates generally to containers. In particular, the present invention relates to containers having two chambers with improved pouring features.

BACKGROUND

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard.

SUMMARY

According to some aspects of the present disclosure, a container includes a bottom, a top opposing the bottom, and a plurality of sides extending from the bottom to the top. The bottom, the top and the plurality of sides define an enclosure. The container includes a partition panel that extends from a first one of the plurality of sides to a second one of the plurality of sides thereby dividing the enclosure into a first chamber and a second chamber. The second one of the plurality of sides opposes the first one of the plurality of sides. The container further includes a pass-through opening in the partition panel configured to permit flow of contents from the second chamber into the first chamber. The container also includes a pour spout configured to permit egress of the contents from the first chamber out of the enclosure.

According to some aspects of the present disclosure, a container includes a bottom, a top opposing the bottom, a front panel and an opposing back panel extending between the bottom and the top, and a first side panel and a second side panel extending from the bottom to the top and extending from the front panel to the back panel. The container further includes a partition panel that extends from the front panel to the back panel. The container also includes a first chamber and a second chamber. The first chamber is defined by the bottom, the top, the front panel, the back panel, the first side panel, and the partition panel. The second chamber is defined by the bottom, the top, the front panel, the back panel, the second side panel, and the partition panel. The second chamber is in communication with the first chamber via a pass-through opening defined at least in part by the partition panel. The container further includes exactly one pour spout configured to permit egress of the contents from the first chamber.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
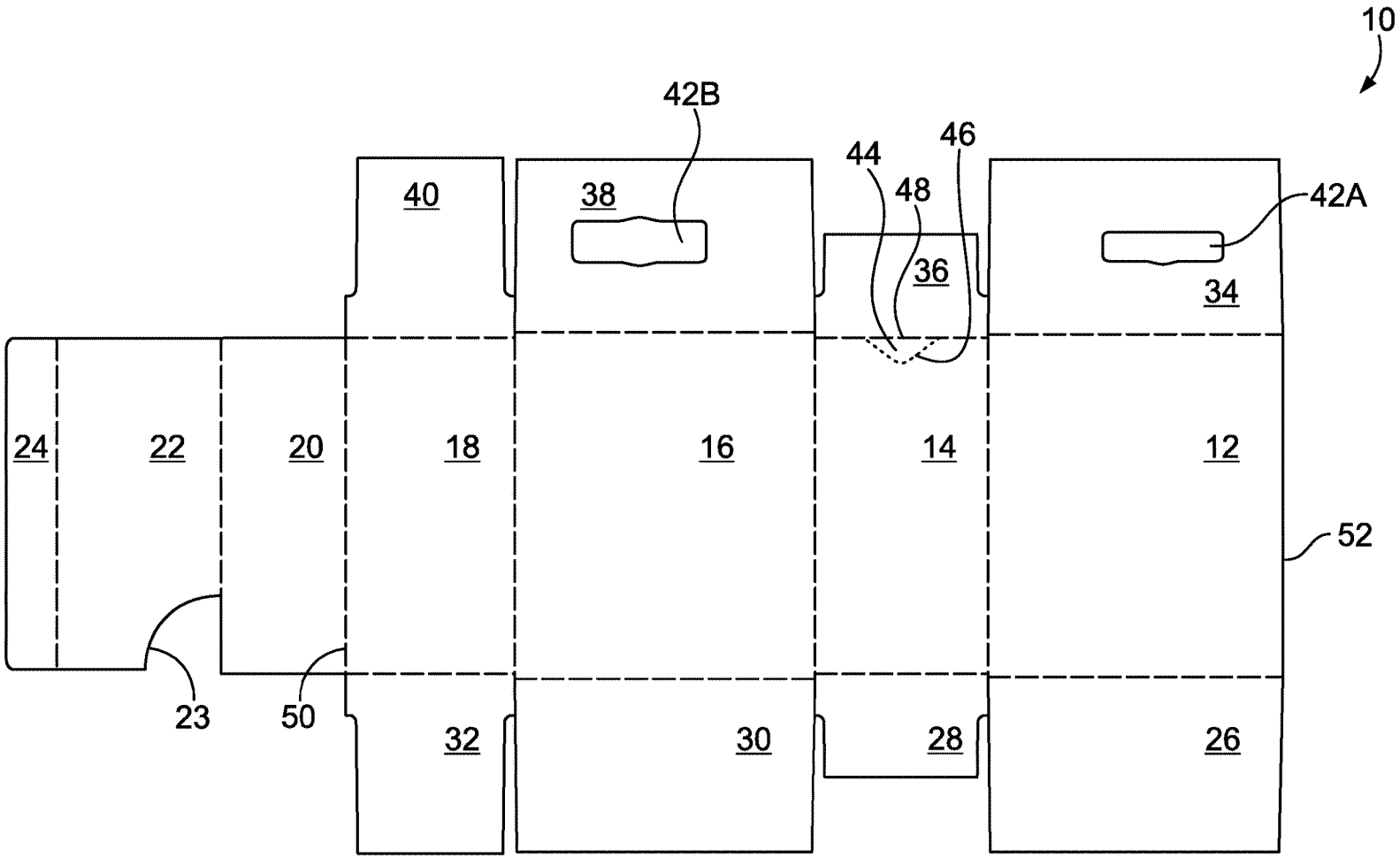
FIG. 1 is a top plan view of a blank for forming a container according to some aspects of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a top plan view of a blank 10 for a container 100 (shown fully assembled in FIG. 5) according to one embodiment of the present disclosure. The blank 10 includes a front panel 12, a first side panel 14, a back panel 16, a second side panel 18, a first attachment panel 20, a partition panel 22, and a second attachment panel 24. The adjacent panels 12, 14, 16, 18, 20, 22, and 24 are connected with one another by substantially parallel fold lines. The partition panel 22 includes a cut-out edge 23 that assists in defining a pass-through opening 72, as will be described in greater detail below. The blank 10 further includes a first major bottom flap 26, a first minor bottom flap 28, a second major bottom flap 30, and a second minor bottom flap 32 hingedly connected to the front panel 12, the first side panel 14, the back panel 16, and the second side panel 18, respectively, by fold lines. The blank 10 also includes a first major top flap 34, a first minor top flap 36, a second major top flap 38, and a second minor top flap 40 hingedly connected to the front panel 12, the first side panel 14, the back panel 16, and the second side panel 18, respectively, by fold lines.

The first major top flap 34 can optionally include a first aperture 42A and the second major top flap 38 includes a second aperture 42B. The first aperture 42A and the second aperture 42B are configured to be aligned when the blank 10 is assembled to form the container 100, as will be described in greater detail below. It is contemplated that the first aperture 42A and the second aperture 42B are not limited to the particular shape, size, and configuration illustrated in FIG. 1. Rather, the first aperture 42A and the second aperture 42B can be formed in other shapes, sizes, and/or locations on the first major top flap 34 and the second major top flap 38.

The first side panel 14 includes a pour spout portion 44 defined by a line of weakness 46 and a fold line 48. The spout portion 44 can be configured to form a pour spout 68 when the container 100 is assembled, as will be described in greater detail below.

Figure 2:
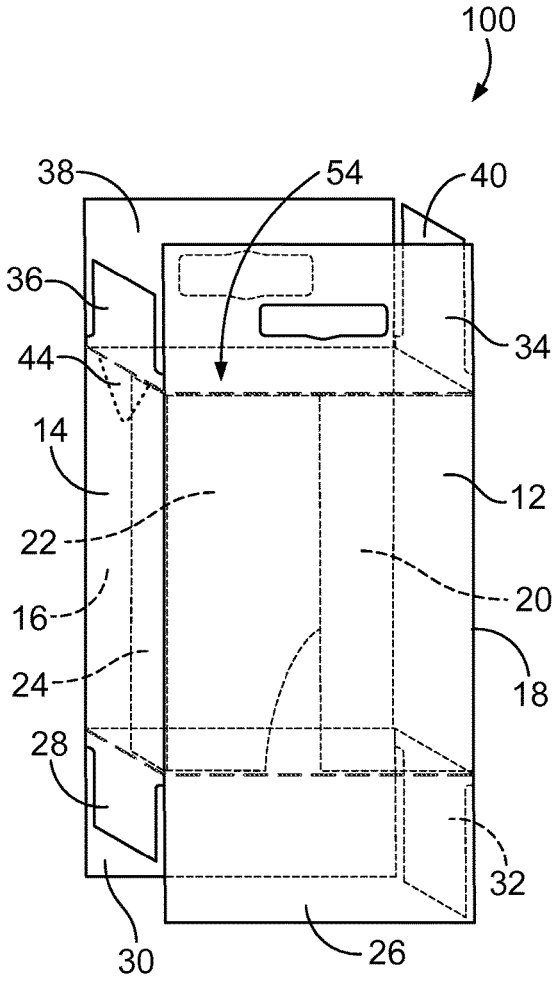
FIG. 2 is a perspective view of the container partially assembled from the blank of FIG. 1.
Figure 3:
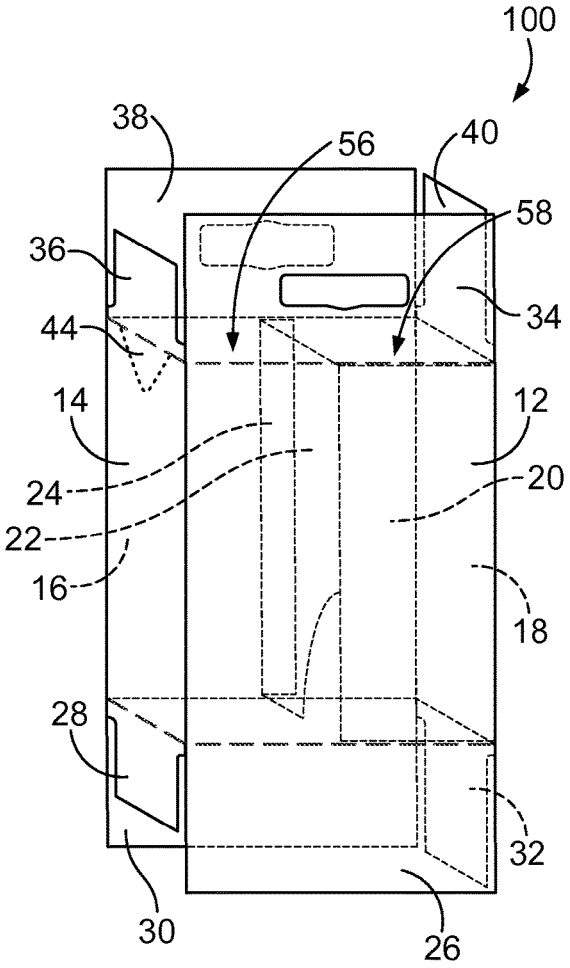
FIG. 3 is a perspective view of the container partially assembled from the blank of FIG. 1.

The assembly of the blank 10 to form the container 100 (shown fully assembled in FIG. 5) will now be described. First, the first attachment panel 20 is attached to the front panel 12 by, for example, a suitable adhesive(s) such that the fold line 50 substantially coincides with a lateral edge 52 of the front panel 12. FIG. 2 shows the resulting partially assembled container 100, which includes an enclosure space 54 defined by the front panel 12, the first side panel 14, the back panel 16, and second side panel 18. Next, the second attachment panel 24 is attached to the back panel 16 by, for example, a suitable adhesive(s), resulting in the partially assembled container 100 shown in FIG. 3. As shown in FIG. 3, the partition panel 22 extends from the front panel 12 to the back panel 16 thereby dividing the enclosure space 54 into a first chamber 56 and a second chamber 58. The first chamber 56 is defined by a portion of the front panel 12, the first side panel 14, a portion of the back panel 16, and the partition panel 22. The second chamber 58 is defined by a portion of the front panel 12, the second side panel 18, a portion of the back panel 16, and the partition panel 22.

In the exemplary embodiment shown in FIG. 3, the partition panel 22 is substantially perpendicular to the front panel 12 and the back panel 16. Additionally, in the illustrated example, the first chamber 56 and the second chamber 58 have substantially the same size. However, it is contemplated that, according to additional or alternative aspects of the present concepts, the partition panel 22 can extend from the front panel 12 to the back panel 16 at a non-perpendicular angle (relative to the front panel 12 and the back panel 16) and/or the first chamber 56 and the second chamber 58 can have different dimensions. Still further, in the illustrated example, the first attachment panel 20 is attached to the first panel 12 such that the fold line 50 substantially coincides with the lateral edge 52; however, it is contemplated that, according to additional or alternative aspects, the fold line connecting the first attachment panel 20 and the partition panel 22 can substantially coincide with the lateral edge 52 or any other portion of the front panel 12.

Figure 4:
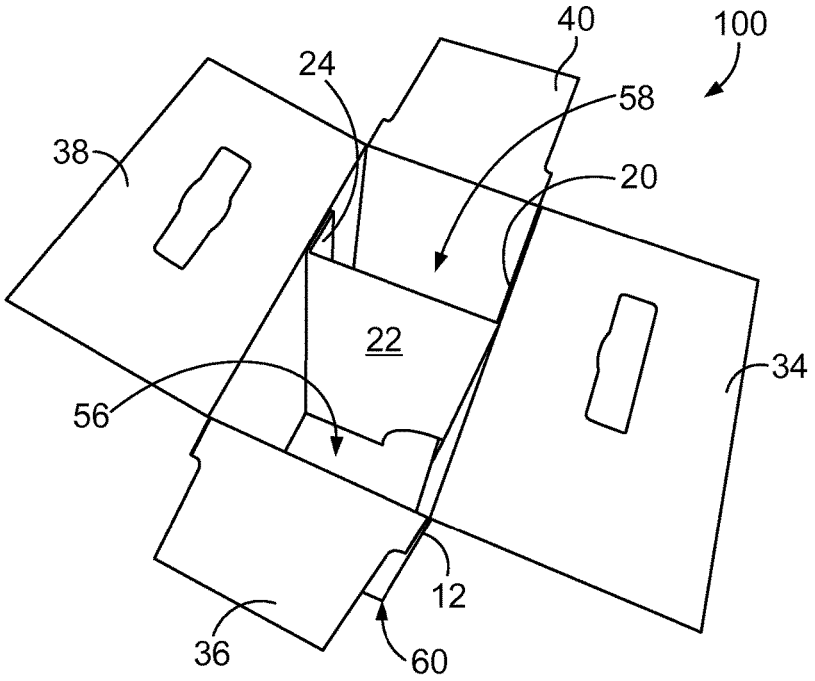
FIG. 4 is a perspective view of the container partially assembled from the blank of FIG. 1.

Next, the first minor bottom flap 28 and the second minor bottom flap 32, followed by the first major bottom flap 26 and the second major bottom flap 30, are folded inward (i.e., towards the enclosure space 54 formed by the panels 12, 14, 16, 18) and sealed (e.g., by tape, staples, adhesives, combinations thereof, and/or the like) to form a bottom 60 of the container 100, as shown in FIG. 4. The first chamber 56 and the second chamber 58 of the container 100 can then be optionally filled with contents through a top opening 62 of the container 100. Then the first minor top flap 36 and the second minor top flap 40, followed by the first major top flap 34 and the second major top flap 38, are folded inwards and sealed (e.g., by tape, staples, adhesives, combinations thereof, and/or the like) to form a top 64 of the container 100, as shown in FIG. 5.

It is contemplated that the assembly of the container 100 described above can be achieved with or without the assistance of a case erector. Additionally, it is contemplated that some of these steps can be performed in a different order than is described above. For example, the top 64 of the container 100 can be formed before forming the bottom 60 of the container 100. It is also contemplated that any suitable method of joining or attaching panels and flaps may be utilized such as, for example, adhesives, glues, staples, tapes, a system of corresponding slits and tabs, combinations thereof, and/or the like.

To facilitate handling and transport, the container 100 can optionally include a handle 66. In the illustrated example shown in FIG. 5, the first aperture 42A in the first major top flap 34 and the second aperture 42B in the second major top flap 38 are aligned to form an opening in the top 64 of the container that is sized and shaped to form the handle 66 in the top 64 of the container 100. It is contemplated that, according to alternative aspects, one or more handles can be provided by one or more portions of material extending outwardly from the top 64 of the container 100.

Figure 5:
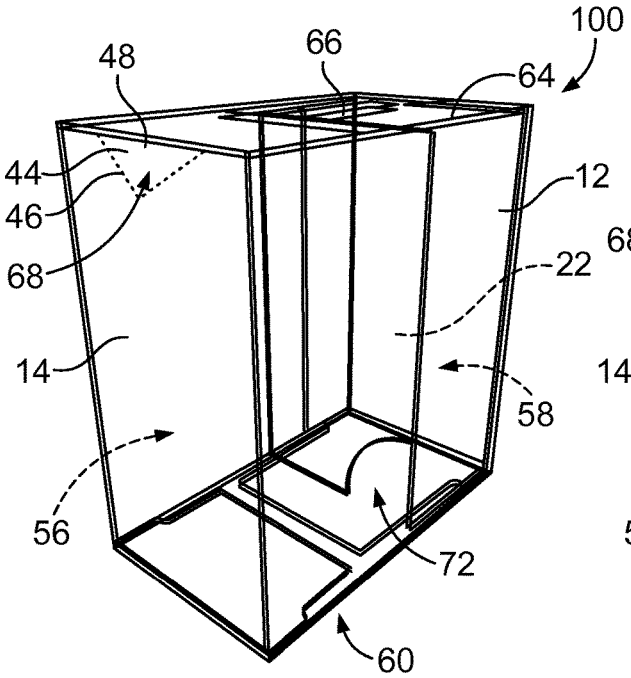
FIG. 5 is a perspective view of the container assembled from the blank of FIG. 1 with the pour spout in a closed position.

With the container 100 assembled as shown in FIG. 5, the contents can be stored and transported within the first chamber 56 and the second chamber 58 of the container 100. The partition panel 22 does not merely provide a surface to separate the first chamber 56 from the second chamber 58. Rather, the partition panel 22 substantially improves the stacking strength and structural integrity of the container. Indeed, the containers of the present concepts exhibit greater stacking strength characteristics than similar containers made of heavier materials but lacking the partition panel 22. As a result, the container 100 can be manufactured with reduced amounts of material at lower costs to achieve a particular stacking strength characteristic, which may be required depending upon the environment in which the container 100 is to be employed. Additionally, for example, by attaching the partition panel 22 to the front panel 12 and the back panel 16 (via the first attachment panel 20 and the second attachment panel 24), the partition panel 22 inhibits bulging by countering the pressure exerted by the contents on the panels 12, 14, 16, 18 of the container 100. As a result, the container 100 more evenly distributes contents within the enclosure 54 and allows for a greater amount of contents to be stored without unacceptable bulging.

In the illustrated example of FIG. 5, the front panel 12 and the back panel 16 have a greater dimension (e.g., width) than the first side panel 14 and the second side panel 18. While the container 100 illustrated in FIG. 5 is generally rectangular in shape, it is contemplated that the container 100 can have other shapes. However, if the container 100 is rectangular in shape, it can be advantageous to attach the partition panel 22 between the sides having the greatest dimensions (e.g., the front panel 12 and the back panel 14). By attaching the partition panel 22 between panels having the greatest dimension, the container's resistance to bulging can be enhanced as bulging tends to be most pronounced along such surfaces due to the greater surface area relative to the other surfaces of the container 100. Additionally, by locating the partition panel 22 approximately equidistant between the opposing side panels 14, 18, the container's resistance to bulging can be further enhanced. However, it should be understood that, according to additional and/or alternative aspects, the partition panel 22 can be attached to panels of the container that do not have the greatest dimension (e.g., the first side panel 14 and the second side panel 18) and/or the partition panel 22 may divide the enclosure 54 of the container 100 into a first chamber 56 that does not have approximately the same size as the second chamber 58.

According to some aspects of the present disclosure, the assembled container 100 can be configured to be sift-proof. That is, the container 100 can be configured such that contents within the container 100 cannot unintentionally migrate out of the container 100. For example, the top flaps 34, 36, 38, 40 and the bottom flaps 26, 28, 30, 32 can be sized and shaped to substantially inhibit and/or prevent gaps in the top 64 and bottom 60, respectively, of the container 100. Additionally, for example, the overlapped coupling of the first attachment panel 20 to the back panel 16 can substantially inhibit and/or prevent the contents from migrating out of the container 100.

Figure 6:
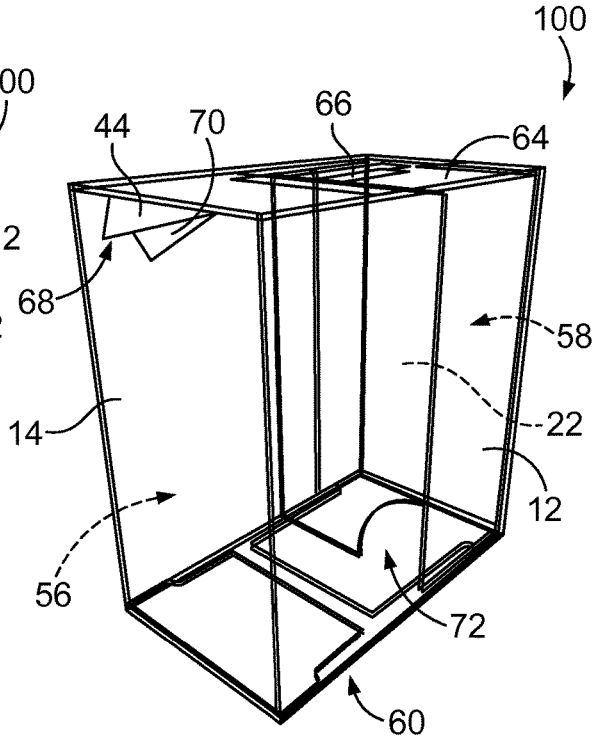
FIG. 6 is a perspective view of the container assembled from the blank of FIG. 1 with the pour spout in a open position.
Figure 7A:
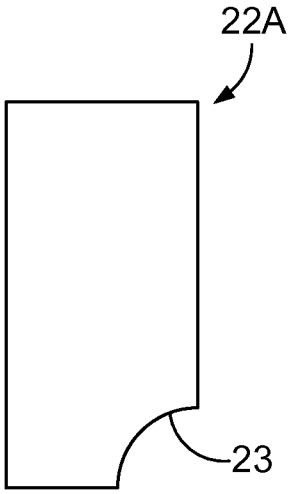
FIGS. 7A-7I is a plan view of a plurality of exemplary partition panel according to aspects of the present disclosure.
Figure 7B:
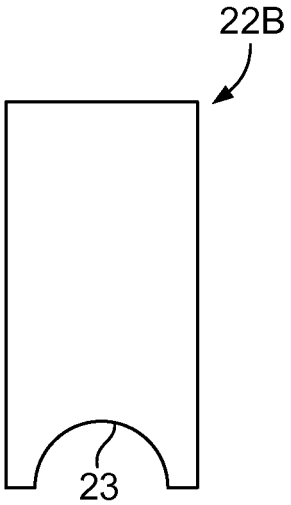
Figure 7C:
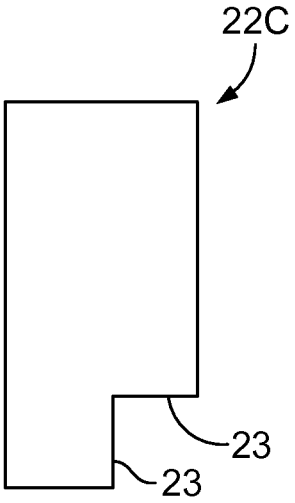
Figure 7D:
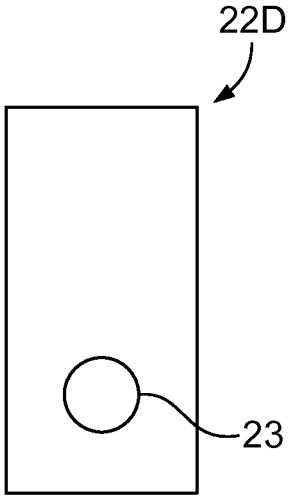
Figure 7E:
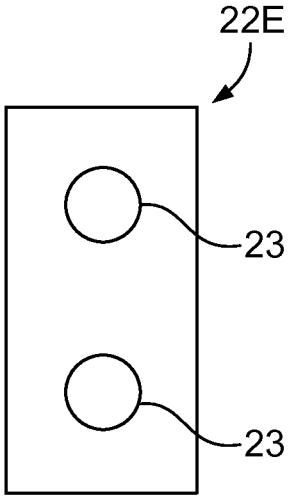
Figure 7F:
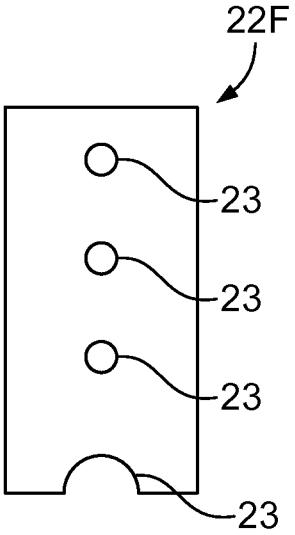
Figure 7G:
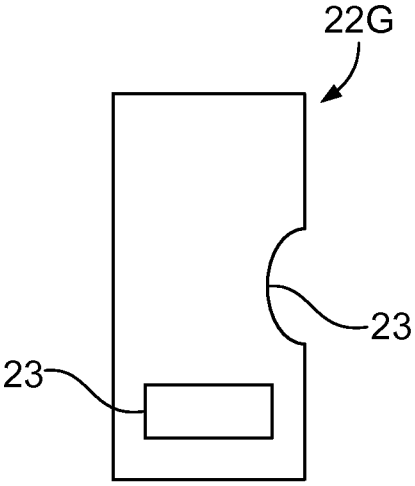
Figure 7H:
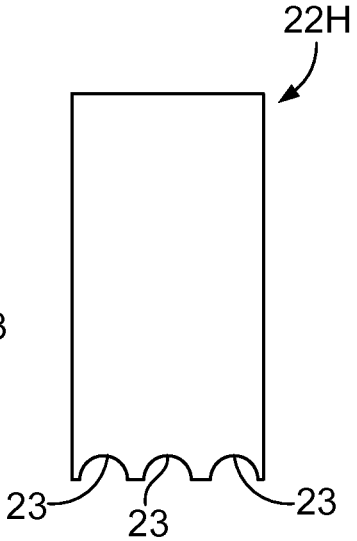
Figure 7I:
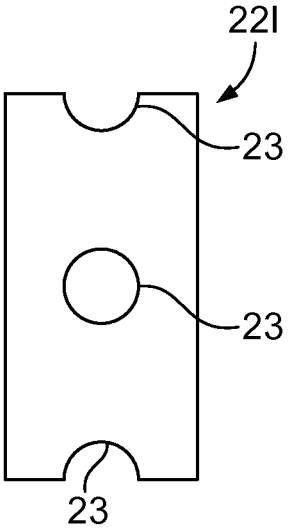

To allow for the contents to be egressed from the enclosure 54, the container 100 can include a pour spout 68. The pour spout 68 includes a closed position (as shown in FIG. 5) in which egress of the contents from the container is substantially prevented. The pour spout 68 also includes an open position (as shown in FIG. 6) in which the contents can egress from the enclosure 54 out of the container 100. In the illustrated example, the pour spout 68 is formed by the pour spout portion 44 of the first side panel 14. To actuate the pour spout 68 from the closed position to the open position, the pour spout portion 44 is separated from the first side panel 14 along the line of weakness 46 and folded generally away from the first side panel 14 along the fold line 48 to form a pour-spout opening 70. With the pour spout 68 in the open position, the contents can be poured from the first chamber 56 out of the container via the pour-spout opening 70. The pour spout 68 can be subsequently reclosed by folding the pour spout portion 44 generally towards the first side panel 14 along the fold line 48.

It is contemplated that, according to additional and/or alternative aspects of the present disclosure, other types of pour spouts 68 can be employed. As one non-limiting example, the first minor top flap 36, the first major top flap 34 and the second major top flap 38 can include a line of weakness and a fold line that are configured to form a pour-spout opening 70 that extends across a portion of the first side panel 14 and the top 64 of the container 100. Additionally, for example, the pour spout 68 can be formed entirely by a line of weakness such that the pour spout 68 cannot be reclosed after being opened.

In some contexts, it may be desirable to provide the same type of contents in both the first chamber 56 and the second chamber 58. In such circumstances (and others), it may be unnecessary to provide more than one pour spout 68. Indeed, there are substantial advantages to providing a single pour spout 68. For example, because the pour spout(s) 68 can include lines of weakness 46, the stacking strength of the container will generally decrease as the number of pour spouts increases. By providing a single pour spout 68, the number of lines of weakness and associated loss of stacking strength can be minimized. As a result, the amount of material required to achieve a particular stacking strength can be reduced, which in turn reduces the cost of manufacture.

As described above, there are a number of significant advantages associated with the partition panel 22 and/or a single pour spout 68; however, such features also present a problem in that the pour spout 68 may only directly communicate with the first chamber 56 such that the contents of the second chamber 58 may not be directly poured from the pour spout 68. According to aspects of the present disclosure, the container 100 addresses this problem by including a pass-through opening 72 configured to permit the contents within the second chamber 58 to move to the first chamber 56. In general, the pass-through opening 72 is defined by at least a portion of the partition panel 22. In the illustrated example shown in FIG. 5, the pass-through opening 72 is defined by the cut-out edge 23 of the partition panel 22, the bottom 60 of the container 100, and the front panel 12. As the contents within the first chamber 56 are poured from the pour spout 68, a portion of the space within the first chamber 56 is vacated by the poured contents. At least a portion of this space can be filled by contents from the second chamber 58 that have egressed from the second chamber 58 into the first chamber 56 via the pass-through opening 72. Additionally, depending on the quantity of the contents in each chamber 56, 58, the container 100 can be manipulated to cause the contents to move between the chambers 56, 58 to more evenly distribute the contents between the first chamber 56 and the second chamber 58 and/or to cause more contents to move from the second chamber 58 to the first chamber 56 for pouring from the pour spout 68.

In the example illustrated in FIG. 5, the cut-out edge 23 has an arc shape (i.e., a shape at least partially defined by a radius), resulting in an arcuately shaped pass-through opening 72. An arcuately shaped pass-through opening 72 can be advantageous because such openings exhibit greater compressions strength characteristics than pass-through openings 72 having shapes that are not based on a radius.

While the example illustrated in FIG. 5 includes a single, arc-shaped pass-through opening 72 located at the bottom 60 of the container, it is contemplated that a container can be provided with one or more pass-through openings 72 having a variety of different configurations. FIGS. 7A-7I illustrate a number of non-limiting examples of partition panels 22A-22I defining different exemplary pass-through opening configurations. As shown in FIGS. 7A-7I, the partition panels 22A-22I can include one or more cut-out edges 23 that define one or more pass-through openings 72 having different sizes, shapes, and locations. It should be understood that the partition panels 22A-22I illustrated in FIGS. 7A-7I are merely examples and the potential configurations of the partition panels 22A-22I are not limited to the illustrated examples.

Figure 8:
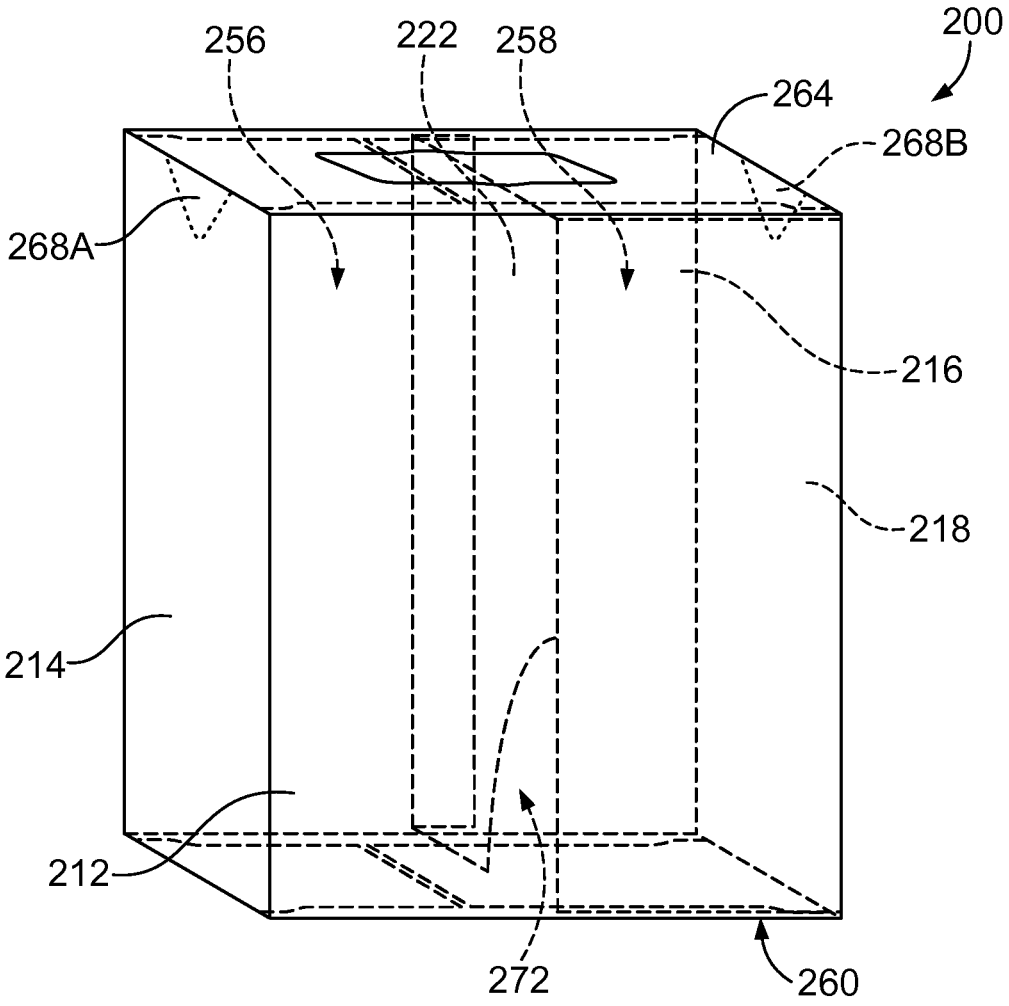
FIG. 8 is a perspective view of a container according to additional aspects of the present disclosure.

In the example illustrated and described with respect to FIGS. 1-6, the container included only a single pour spout 68. While a container including a single pour spout can include substantial advantages as described above, it is contemplated that a container having a partition panel with a pass-through opening 72 also can be advantageously employed in a container having a plurality of pour spouts. FIG. 8 illustrates one non-limiting example of a container 200 that is substantially similar to the container 100 described above, except the container 200 includes a plurality of pour spouts 268A, 268B. The container 200 further includes a plurality of panels forming sides 212, 214, 216, 218 of the container 200, a top 264, and a bottom 260 that define an enclosure 254. The container 200 also includes a partition panel 222 that separates the enclosure 254 into a first chamber 256 and a second chamber 258. A first pour spout 268A is in direct communication with the first chamber 256 and a second pour spout 268B is in direct communication with the second chamber 258. The partition panel 222 provides improved stacking support and substantially inhibits bulging so that lighter materials can be employed and more contents can be stored within the container 200.

The container 200 having a plurality of pour spouts 268A, 268B can provide improved flexibility and convenience for pouring contents from the container 200 compared to a similar container having a single pour spout. Indeed, the plurality of pour spouts 268A, 268B allow the user to pour the contents from whichever side of the container 200 is closer to the intended destination target. As a result, the user may have to reposition or move a potentially heavy container 200 less frequently. This benefit is realized because the container 200 includes a pass-through opening 272 that permits the contents to move between the first chamber 256 and the second chamber 258 such that the user can pour from either side until both chambers 256, 258 are empty. The pass-through opening 272 can also facilitate a more even distribution of the contents in the first chamber 256 and the second chamber 258. As a result, the user can pour the contents from the container 200 without worry as to the respective volumes of the contents within each individual chamber 254, 256.

The containers 100, 200 described herein are typically manufactured using corrugated paperboard, preferably with the corrugations running in a vertical direction for increased strength. As non-limiting examples, the container is manufactured from C-flute, EB-flute, E-flute or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

It is contemplated that the containers 100, 200 described herein can have any suitable dimensions. As one non-limiting example, the panels 12, 14, 16, 18, 20, 22, 24 can have a height(s) and a width(s) from approximately 4 inches (101.60 millimeters) to approximately 60 inches (1524.00 millimeters) and the flaps 26, 28, 30, 32, 34, 36, 38, 40 can each have a height(s) and a width(s) from approximately 0 inches (0 millimeters) to approximately 60 inches (1524.00 millimeters). As another non-limiting example, the front panel 12 can have a height of approximately 13.25 inches (336.55 millimeters) and a width of approximately 11.56 inches (293.62 millimeters), the first side panel 14 can have a height of approximately 13.06 inches (331.72 millimeters) and a width of approximately 6.81 inches (172.97 millimeters), the back panel 16 can have a height of approximately 13.44 inches (341.38 millimeters) and a width of approximately 11.75 inches (298.45 millimeters), the second side panel 18 can have a height of approximately 13.06 inches (331.72 millimeters) and a width of approximately 6.63 inches (168.40 millimeters), the first attachment panel 20 can have a height of approximately 13.06 inches (331.72 millimeters) and a width of approximately 4.94 inches (125.48 millimeters), the partition panel 22 can have a height of approximately 13.06 inches (331.72 millimeters) and a width of approximately 6.44 inches (163.58 millimeters), and the second attachment panel 24 can have a height of approximately 13.06 inches (331.72 millimeters) and a width of approximately 2 inches (50.80 millimeters), the first major top flap 34 and the first major bottom flap 26 can have a height of approximately 6.88 (174.75 millimeters) and a width of approximately 11.56 (293.62 millimeters), the first minor top flap 36 and the first minor bottom flap 28 can have a height of approximately 4 inches (101.60 millimeters) and a width of approximately 6.81 inches (172.97 millimeters), the second major top flap 38 and the second major bottom flap 30 can have a height of approximately 6.78 inches (172.21 millimeters) and a width of approximately 11.75 inches (298.45 millimeters), and the second minor top flap 40 and the second minor bottom flap 32 can have a height of approximately 6.97 inches (177.04 millimeters) and a width of approximately 6.63 inches (168.40 millimeters).

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container formed from a blank having a plurality of panels, the container comprising:

a bottom;

a top opposing the bottom;

a plurality of sides extending from the bottom to the top, the bottom, the top and the plurality of sides defining an enclosure;

a partition panel extending from a first one of the plurality of sides to a second one of the plurality of sides thereby dividing the enclosure into a first chamber and a second chamber, the second one of the plurality of sides opposing the first one of the plurality of sides, the first chamber having a plurality of side walls, at least two of the plurality of side walls each having a thickness of a single panel, at least a portion of the partition panel extending from the bottom to the top;

a first pass-through opening in the partition panel configured to permit flow of contents from the second chamber into the first chamber, the first pass-through opening being defined by at least the partition panel, the bottom and at least one of the sides of the container, the first and the second chambers being in constant communication with each other via the first pass-through opening; and a pour spout configured to permit egress of the contents from the first chamber out of the enclosure.

2. The container of claim 1, further comprising a first attachment panel and a second attachment panel, the partition panel being integrally formed with and located between the first attachment panel and the second attachment panel, the first attachment panel being attached to the first one of the plurality of sides and the second attachment panel being attached to the second one of the plurality of sides, the first pass-through opening being defined entirely by the partition panel, the bottom and the second one of the plurality of sides.

3. The container of claim 2, wherein the first attachment panel is also integrally formed with a third one of the plurality of sides such that the first attachment panel is located between the third one of the plurality of sides and the partition panel.

4. A container formed from a blank having a plurality of panels, the container comprising:

a bottom;

a top opposing the bottom;

a plurality of sides extending from the bottom to the top, the bottom, the top and the plurality of sides defining an enclosure;

a partition panel extending from a first one of the plurality of sides to a second one of the plurality of sides thereby dividing the enclosure into a first chamber and a second chamber, the second one of the plurality of sides opposing the first one of the plurality of sides, the first chamber having a plurality of side walls, at least two of the plurality of side walls each having a thickness of a single panel, at least a portion of the partition panel extending from the bottom to the top;

a pass-through opening in the partition panel configured to permit flow of contents from the second chamber into the first chamber, the pass-through opening is defined by at least the partition panel and the bottom, the first and the second chambers being in constant communication with each other via the pass-through opening; and a pour spout configured to permit egress of the contents from the first chamber out of the enclosure.

5. The container of claim 1, wherein the container further includes a second pass-through opening, the first and the second chambers being in constant communication with each other via the second pass-through opening.

6. The container of claim 1, wherein the first pass-through opening includes a surface having a shape defined by a radius.

7. The container of claim 1, wherein the plurality of sides includes a first side, a second side, a third side, and a fourth side, the first side opposing the third side, and the second side opposing the fourth side, the first side and the third side having a greater width than the second side and the fourth side, the partition panel being attached to the first side and the third side.

8. The container of claim 1, wherein the pour spout is configured to be repeatedly opened and closed.

9. The container of claim 8, wherein the top includes a plurality of top flaps and the bottom includes a plurality of bottom flaps, the plurality of top flaps and the plurality of bottom flaps being configured such that the contents cannot migrate out of the enclosure when the pour spot is closed.

10. The container of claim 1, further comprising one or more additional pour spouts.

11. A container comprising:

a bottom;

a top opposing the bottom;

a front panel and an opposing back panel extending between the bottom and the top;

a first side panel and a second side panel extending from the bottom to the top and extending from the front panel to the back panel;

a partition panel extending from the front panel to the back panel, at least a portion of the partition panel extending from the bottom to the top;

a first chamber having a plurality of sides defined by at least the bottom, the top, the front panel, the back panel, the first side panel, and the partition panel, one of the plurality of sides of the first chamber being defined by only the first side panel;

a second chamber having a plurality of sides defined by at least the bottom, the top, the front panel, the back panel, the second side panel, and the partition panel, the second chamber being in constant communication with the first chamber via a pass-through opening defined at least in part by the partition panel and the bottom, one of the plurality of sides of the second chamber being defined by only the second side panel; and exactly one pour spout configured to permit egress of the contents from the first chamber.

12. The container of claim 11, further comprising:

a first attachment panel integrally formed with and located between the partition panel and the second side panel, the first attachment panel being attached to the back panel; and a second attachment panel integrally formed with the partition panel, the second attachment panel being attached to the front panel.

13. The container of claim 11, wherein the pass-through opening is defined entirely by the front panel, the bottom, and the partition panel.

14. The container of claim 11, further comprising a handle formed in the top.

15. The container of claim 11, wherein the pour spout is defined by at least a portion of the top and the second side panel.

16. The container of claim 11, further comprising contents disposed in the first chamber and the second chamber, the pass-through opening being configured to facilitate transfer of a first portion of the contents from the second chamber to the first chamber as a second portion of the contents is poured out of the first chamber via the pour spout.

17. The container of claim 11, wherein the pour spout is integrally formed with the container.

18. The container of claim 1, wherein the plurality of sides and the partition panel have the same approximate height such that at least a portion of the partition panel extends between the bottom and the top.

19. The container of claim 1, wherein all of the side walls of the first chamber have the same thickness.

20. The container of claim 1, wherein the second chamber has a plurality of side walls and at least two of the plurality of side walls of the second chamber each have the thickness of the single panel.

21. The container of claim 11, wherein the front panel, the back panel, the first side panel, the second side panel, and the partition panel have the same approximate height such that at least a portion of the partition panel extends between the bottom and the top.

* * * * *